US009681757B2

(12) United States Patent
Svensrud

(10) Patent No.: US 9,681,757 B2
(45) Date of Patent: Jun. 20, 2017

(54) SYSTEMS, COMPONENTS AND RELATED METHODS

(75) Inventor: Chris Svensrud, Torrance, CA (US)

(73) Assignee: Nook Sleep Systems LLC, Hawthorne, CA (US)

( * ) Notice: Subject to any disclaimer, the term of this patent is extended or adjusted under 35 U.S.C. 154(b) by 325 days.

(21) Appl. No.: 12/804,476

(22) Filed: Jul. 21, 2010

(65) Prior Publication Data

US 2011/0016635 A1 Jan. 27, 2011

Related U.S. Application Data

(60) Provisional application No. 61/271,592, filed on Jul. 22, 2009.

(51) Int. Cl.

| | |
|---|---|
| ***A47C 16/04*** | (2006.01) |
| ***A47C 27/14*** | (2006.01) |
| ***A61G 7/057*** | (2006.01) |
| ***A47C 31/00*** | (2006.01) |
| *A47D 15/00* | (2006.01) |

(52) U.S. Cl.

CPC ..... *A47C 27/14* (2013.01); *A47C 27/146* (2013.01); *A47C 31/007* (2013.01); *A61G 7/05707* (2013.01); *A47D 15/001* (2013.01)

(58) Field of Classification Search

CPC ..... A47C 27/00; A47C 27/026; A47C 27/05; A47C 27/14; A47C 16/04; A47C 27/02; A47C 27/146; A47C 31/105; A61G 7/05707; A47D 15/001; A47G 9/1054

USPC ..... 5/724, 725, 652.1

See application file for complete search history.

(56) References Cited

U.S. PATENT DOCUMENTS

| | | | | | |
|---|---|---|---|---|---|
| 934,465 | A | * | 9/1909 | Rust | 5/652.1 |
| 1,727,961 | A | * | 9/1929 | Brown | 5/724 |
| 3,066,928 | A | * | 12/1962 | Lawrence et al. | 267/145 |
| 3,391,413 | A | * | 7/1968 | Crane et al. | 297/452.45 |
| 3,939,508 | A | * | 2/1976 | Hall et al. | 5/727 |
| 3,974,532 | A | * | 8/1976 | Ecchuya | 5/724 |
| 4,143,435 | A | | 3/1979 | Masuda | |
| 4,574,411 | A | * | 3/1986 | Yagi | A47C 21/046 5/421 |
| 4,605,582 | A | * | 8/1986 | Sias | A61G 7/05707 428/120 |
| 4,614,000 | A | * | 9/1986 | Mayer | 5/484 |

(Continued)

*Primary Examiner* — Nicholas Polito
*Assistant Examiner* — Ifeolu Adeboyejo
(74) *Attorney, Agent, or Firm* — Jeffrey A. McKinney; McKinney Law Group APC

(57) ABSTRACT

The present invention is generally directed to systems related to sleeping, playing and provision of non-toxic environments, components related to those systems, and methods involving the systems or components. It is more particularly directed to systems, components and methods that aid early infant cognitive development, improve ventilation inside a crib, promote fresh and/or odor free air, promote thermoregulation and homeostasis, protect the person using the systems, components and methods from biological toxins, and create healthy sleeping environments for infants, toddlers, children and adults. One sleep system according to the present invention includes a cover, a core, and a bottom. The cover includes at least two raised areas. The raised areas have one or more heights ranging from 0.125 inch to 5.0 inches and diameters ranging of 0.25 to 10.0 inches.

6 Claims, 9 Drawing Sheets

(56) References Cited

U.S. PATENT DOCUMENTS 4,686,724 A * 8/1987 Bedford ..... 5/652.1
4,686,725 A 8/1987 Mitchell
4,768,251 A * 9/1988 Baskent ..... A47C 27/146 5/722
4,850,068 A * 7/1989 Walpin ..... A47G 9/10 5/636
4,866,800 A 9/1989 Bedford
4,873,734 A 10/1989 Pollard
4,899,405 A * 2/1990 Rothbard ..... A47G 9/10 5/636
4,901,387 A * 2/1990 Luke ..... A47C 27/146 5/727
4,918,774 A * 4/1990 Popitz ..... A47G 9/10 5/636
4,967,433 A * 11/1990 Neal ..... A61G 7/05707 5/655.9
4,995,127 A 2/1991 Inagaki
5,007,124 A * 4/1991 Raburn et al. ..... 5/731
5,010,609 A * 4/1991 Farley ..... B29C 44/5654 5/730
5,083,335 A * 1/1992 Krouskop et al. ..... 5/730
5,084,926 A * 2/1992 Wattie ..... A47G 9/10 5/636
5,115,527 A * 5/1992 Medley ..... 5/731
5,138,732 A * 8/1992 Wattie ..... A47G 9/10 5/636
5,153,956 A * 10/1992 Nold ..... A61G 7/05707 428/218
5,193,236 A * 3/1993 Komuro ..... A47C 31/003 5/636
5,317,768 A * 6/1994 Klancnik ..... 5/736
5,325,552 A * 7/1994 Fong ..... 5/724
5,402,545 A * 4/1995 Jolley ..... A47C 7/022 297/467
5,459,896 A * 10/1995 Raburn et al. ..... 5/653
5,533,220 A * 7/1996 Sebag ..... A61G 7/05707 5/654
5,607,749 A 3/1997 Strumor
5,671,492 A 9/1997 Simon
5,701,621 A * 12/1997 Landi et al. ..... 5/691
5,749,111 A * 5/1998 Pearce ..... 5/652
5,850,648 A * 12/1998 Morson ..... 5/724
5,887,304 A * 3/1999 von der Heyde ..... 5/726
6,055,690 A * 5/2000 Koenig ..... 5/724
6,199,234 B1 * 3/2001 Srour et al. ..... 5/736
6,601,253 B1 8/2003 Tarquinio
6,760,937 B1 * 7/2004 Ou ..... 5/652.1
7,059,001 B2 * 6/2006 Woolfson ..... 5/740
7,334,280 B1 * 2/2008 Swartzburg ..... 5/724
7,571,504 B2 * 8/2009 Kuo ..... 5/724
7,661,165 B2 * 2/2010 Piccinini et al. ..... 5/720
2006/0112490 A1 * 6/2006 Chausse ..... 5/690
2007/0204402 A1 9/2007 Harris et al.
2007/0261173 A1 * 11/2007 Schlussel ..... 5/725
2007/0283502 A1 12/2007 Tullous
2008/0016622 A1 * 1/2008 Prust ..... 5/653
2008/0060139 A1 * 3/2008 Mossbeck ..... 5/724
2009/0013472 A1 * 1/2009 Koffler et al. ..... 5/652.1
2009/0249553 A1 * 10/2009 Gabbai et al. ..... 5/724
2010/0122417 A1 * 5/2010 Vrzalik et al. ..... 5/652.1
2010/0129573 A1 * 5/2010 Kim ..... 428/34.1
2010/0175196 A1 * 7/2010 Lafleche et al. ..... 5/707

* cited by examiner

SYSTEMS, COMPONENTS AND RELATED METHODS

CROSS-REFERENCE TO RELATED APPLICATION

This application claims priority to U.S. Provisional Patent Application Ser. No. 61/271,592 filed on Jul. 22, 2009, the entire disclosure of which is incorporated by reference.

FIELD OF THE INVENTION

The present invention is generally directed to systems related to sleeping, playing and provision of non-toxic environments, components related to those systems, and methods involving the systems or components. It is more particularly directed to systems, components and methods that aid early infant cognitive development, improve ventilation inside a crib, promote fresh and/or odor free air, promote thermoregulation and homeostasis, protect the person using the systems, components and methods from biological toxins, and create healthy sleeping environments for infants, toddlers, children and adults.

BACKGROUND OF THE INVENTION

The first mattress was probably made over 6,000 years ago and consisted of leaves, grass or straw with animal skins over it. Mattresses of today include three components: a support core; a foundation; and upholstery layers. The support core primarily provides a mattress's load bearing function. Most support cores are either spring cores—i.e., "innersprings" that are made of steel coil springs—or foam cores—i.e., shape-conforming latex or viscoelastic memory foam.

There are three main types of foundations: box-springs include a rigid frame with heavy-duty springs; traditional wood foundations are usually made of soft woods and consist of support slats covered with cardboard or beaverboard; grid foundations are a combination of steel and wood. The foundation provides a secondary source of support for a person's body.

The upholstery layer is sometimes called the "comfort layer." It is composed of an insulator, middle upholstery and a quilt. The insulator is typically fiber or mesh and serves to separate the support core from the middle upholstery. Materials within the middle upholstery are foams or fibers intended to provide comfort to a person. The quilt provides the soft surface on top of a mattress and is usually constructed of light foam or fibers.

Despite all the mattresses that have been designed and produced over the last 6,000 years, there is still a need for new designs that meet objectives identified today.

SUMMARY OF THE INVENTION

The present invention is generally directed to systems related to sleeping, playing and provision of non-toxic environments, components related to those systems, and methods involving the systems or components. It is more particularly directed to systems, components and methods that aid early infant cognitive development, improve ventilation inside a crib, promote fresh and/or odor free air, promote thermoregulation and homeostasis, protect the person using the systems, components and methods from biological toxins, and create healthy sleeping environments for infants, toddlers, children and adults.

In a system aspect, the present invention is directed to a sleep system including a cover, a core, and a bottom. The cover includes at least two raised areas. The raised areas have one or more heights ranging from 0.125 inch to 5.0 inches.

In a method aspect, the present invention is directed to a method of marketing a sleep system. The method involves a marketing pitch directed to a natural sleep system that stimulates the cognitive development of an infant. The sleep system includes: a) a cover; b) a core; and, c) a bottom, and the cover comprises at least two raised areas.

In another method aspect, the present invention is directed to a method of aiding infants in the development of cognitive skills. The method involves providing a sleep system for the infant to sleep on. The sleep system includes a cover, a core and a bottom. The cover includes at least two raised areas that have one or more heights ranging from 0.125 inch to 5.0 inches.

In still another method aspect, the present invention is directed to a method for decreasing the $CO_2$ concentration in the breathing space surrounding a sleeper. The method involves providing a sleep system for the sleeper to sleep on. The sleep system includes a cover, a core and a bottom. The cover includes at least two raised areas that have one or more heights ranging from 0.125 inch to 5.0 inches.

In another aspect, the present invention is directed to a sleep system that is protected from biological toxins. The sleep system provides a durable bacteriostatic and fungistatic surface effective against a large number of gram-positive and gram-negative bacteria, yeast, micro-fungi, mildew/mold and algae. This provides a healthier sleeping environment and protects against microbial damage on the fibers, which affords longer lasting system components.

In another aspect, the present invention is directed to a sleep system that provides temperature regulation through both passive (e.g., moisture wicking fibers) and active (e.g., phase change materials and fibers) means. This involves a sleep system that enhances the body's natural tendency to achieve sleep homeostasis.

In another aspect, the present invention provides a sleep system that eliminates the need for a mattress pad. This is an improvement over mattresses where pads are required, since pads lead to decreased breathability, ventilation, temperature regulation, and microbe protection.

DETAILED DESCRIPTION OF THE INVENTION

Figure 1:
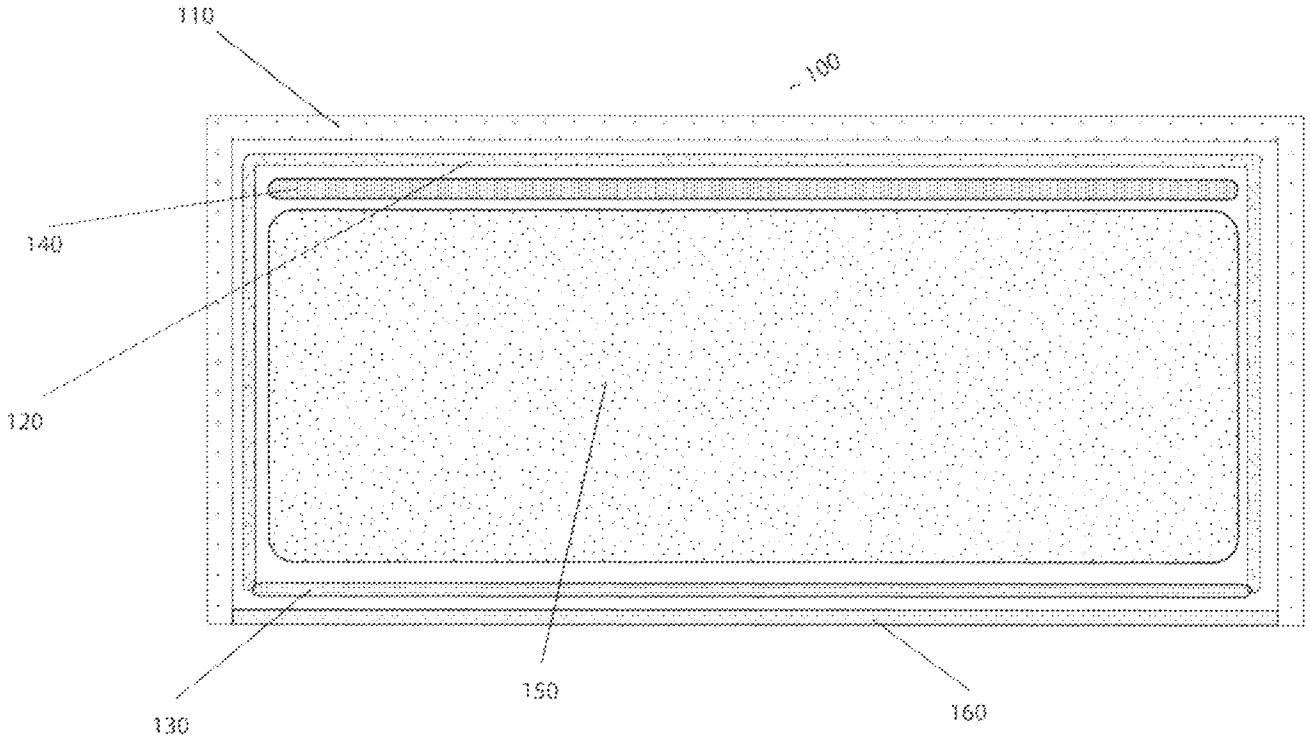
FIG. 1 shows one example of a sleep system according to the present invention.
Figure 2:
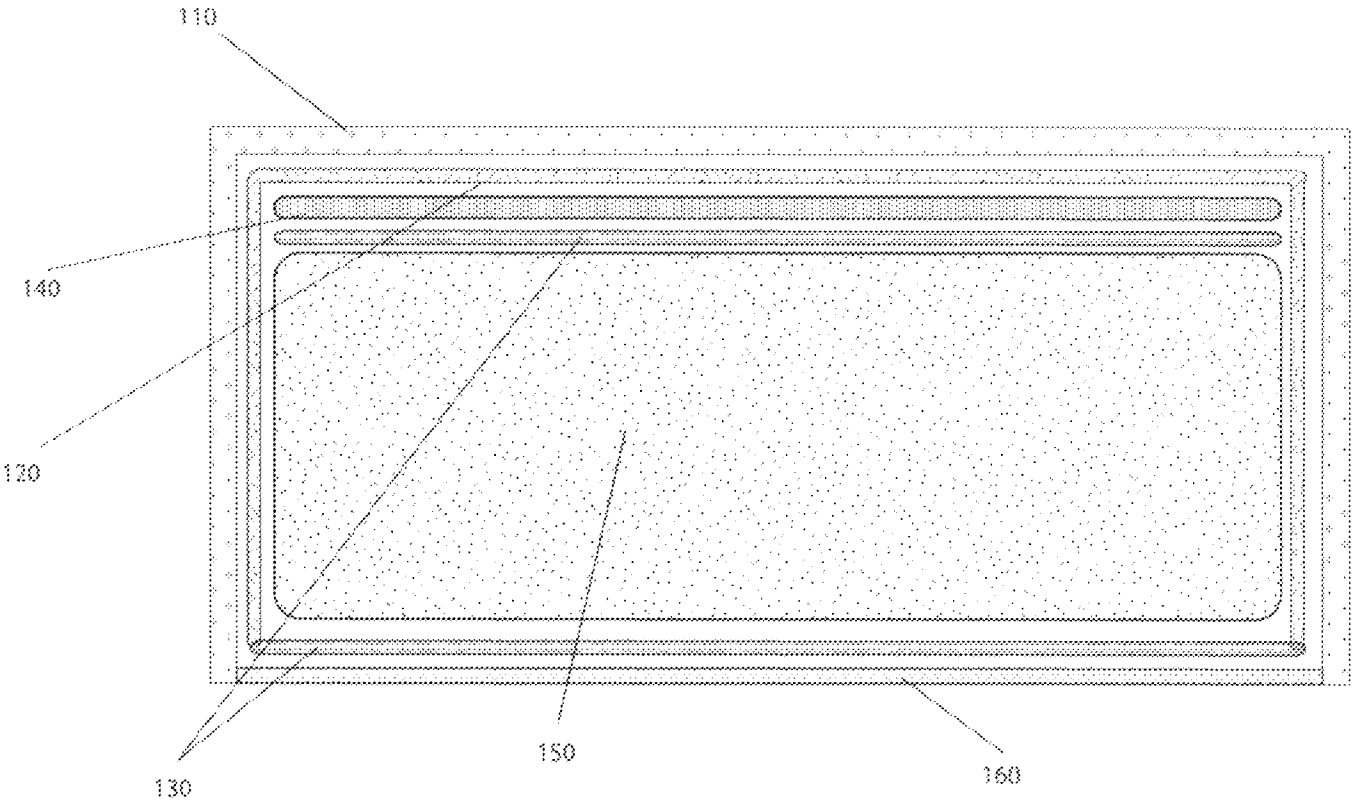
FIG. 2 shows a slightly varied example of a sleep system shown in FIG. 1.

A general sleep system (100) according to the present invention is described in reference to FIG. 1. (FIG. 2 shows a slight variation on the same general sleep system.) Sleep system 100 has six basic components: a removable cover (110); a first fire barrier (120); a second fire barrier (130); a three-dimensional spacer (140); a core (150); and a structurally fortified bottom (160).

Figure 9A:
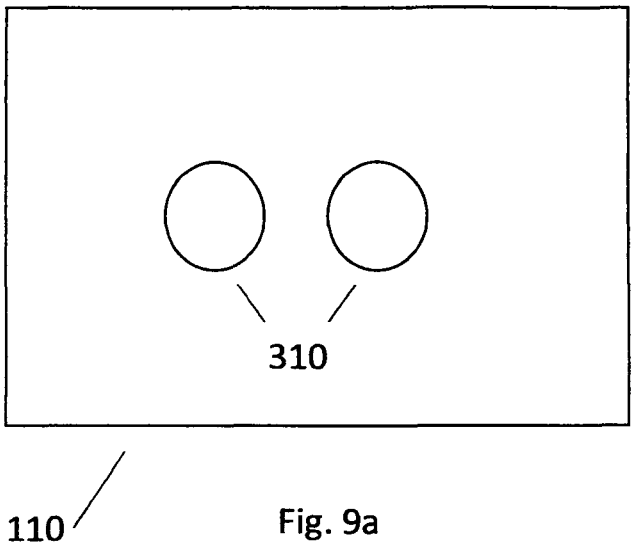
FIG. 9 shows a top view (FIG. 9*a*) and a side view (9*b*) of a cover 110.
Figure 9B:
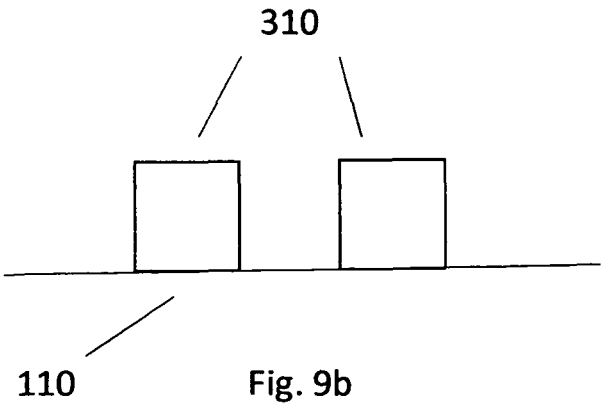

Cover 110 is removable and washable. It has a textured surface and consists of raised areas that create high relief. The raised areas are typically circular (310 in FIGS. 9*a* and 9*b*) or roughly circular, although other shapes may sometimes be used (e.g., triangles, squares, rectangles, pentagons, hexagons, heptagons, octagons, ovals, ellipses, animal shapes, flowers, planets, regular polygons, irregular polygons, abstract designs, etc.). The raised areas may also be line-like areas that form patterns on the cover 110, such as parallel lines, swirls, or a checkerboard pattern. Where the shapes are circular or roughly circular they are at least 0.125 inches in height (highest point on raised area) and at least 0.25 inch in diameter. In general, the raised area height ranges from 0.125 inch to 5.0 inches; non-limiting examples of such heights are 0.25 inch, 0.50 inch, 0.75 inch, 1.0 inch, 1.25 inches, 1.50 inches, 1.75 inches, 2.0 inches, 2.5 inches, 3.0 inches, 3.5 inches, 4.0 inches, 4.5 inches, 5.0 inches.

The raised areas oftentimes exist in pods, which are collections of raised areas ranging from two raised areas to three hundred raised areas. Where the shapes of raised areas in the pods are circular or roughly circular, the pods include raised areas of varying diameters (i.e., at least two raised areas within the pod have different diameters). In general, the diameters range from 0.25 inch to 10.0 inches; non-limiting examples of such diameters are 0.25, inch, 0.50 inch, 0.75 inch, 1.0 inch, 1.5 inches, 2.0 inches, 2.5 inches, 3.0 inches, 3.5 inches, 4.0 inches, 4.5 inches, 5.0 inches, 5.5 inches, 6.0 inches, 6.5 inches, 7.0 inches, 7.5 inches, 8.0 inches, 8.5 inches, 9.0 inches, 9.5 inches and 10.0 inches. In certain cases the diameters of circular or roughly circular raised areas are in a pod, and they are selected from a group consisting of 1.0 inch diameters, 3.0 inch diameters and 5.0 inch diameters.

Spacing between raised areas is at least 0.10 inch and can be as much as 20.0 inches. In certain cases, the spacing ranges from 0.25 inch to 1.0 inch; non-limiting examples of such spacing are 0.25 inch, 0.30 inch, 0.35 inch, 0.40 inch, 0.45 inch, 0.50 inch, 0.55 inch, 0.60 inch, 0.65 inch, 0.70 inch, 0.75 inch, 0.80 inch, 0.85 inch, 0.90 inch, 0.95 inch and 1.0 inch. A particularly useful spacing is the sum of the height of two adjacent raised areas divided by 1.618. For example, if one raised area is 0.25 inch high, and an adjacent area is 0.50 inch high, the particularly useful spacing would be determined by the following equation: [0.25+0.50]/1.618, which is 0.46 inch.

The raised areas are of sufficient firmness such that they do not depress under their own weight. The cover fabric typically consists of what is commonly referred to as a 'double knit' constructed by sandwiching loose yarns, referred to as inlay yarns, between a surface knit and a bottom knit and then weaving the two fabrics together. The inlay yarns are introduced to a temporary high heat environment greater than or equal to 200° F. (e.g., 200° F. to 400° F. or 300° F. to 350° F.), thereby increasing the displacement volume of the fibers by at least 2.0 percent. Such raised areas are typically created in the fabric using a novel knitting technique, whereby fibers are not woven down where a raised area is desired. The inlay yarns, having a greater volume when exposed to high heat, fill the areas where the weaving is not present, which creates a raised area.

Asymmetric cover 110 includes a design, which is typically directed to a natural theme. Non-limiting examples of such themes include stones, tree bark, grass, flowers, water, lava, leaves, sky are typical examples and any combinations thereof. FIG. 4 through FIG. 8 show four such designs.

The binding feature, e.g., zipper, that allows cover 110 to be removable is oftentimes hidden from sight so the mattress appears as a solid form. Inner zippers are typically constructed to give users visual indications as to how the mattress is disassembled and assembled.

The cover 110 is typically constructed of a natural fiber. One example of a natural fiber is Lyocell, which is a biodegradable fabric made from wood pulp cellulose (TENCEL® is a brand of Lyocell). Lyocell is naturally resistant to the growth of bacteria and fungus. It furthermore possesses superior moisture-wicking, breathability and air exchange between cover 110 and lower layers such as first fire barrier 120 and three-dimensional spacer 140.

The fiber used for cover 110 can be optionally coated with a non-toxic, washable outer fabric finish that provides water and stain resistance and/or a silver-particle or zinc-particle finish based finish to resist bacteria and mold growth. A non-limiting example of a stain resistant fabric finish is the naturally self-cleaning finish sold by NANOSPHERE®; a non-limiting example of silver-particle and zinc-particle based finishes are those sold by SANITIZED®.

NANOSPHERE or other breathable water, oil, and stain resistant coatings eliminate the need for a mattress pad. Mattress pads used in other systems are bulky, prone to bacterial growth and limit the breathability of the sleep system. The elimination of the mattress pads allows for the enhanced breathability, temperature regulation, and clean odor free air to circulate in the sleep system and sleeping environment.

First fire barrier 120 is typically a non-toxic fire barrier that is very porous, which allows air and moisture flow from cover 110 to lower mattress components. One example of such a barrier is a fiber made of modified rayon and virgin polyester. The rayon turns to silica at the time of burn. The weight of the material oftentimes ranges from 3.0 oz/yd$^2$ to 8.0 oz/yd$^2$, with 4.0 oz/yd$^2$, 4.3 oz/yd$^2$, 4.95 oz/yd$^2$ and 7.08 oz/yd$^2$ being commonly used weights (e.g., from Freudenberg Nonwovens, Durham, N.C.).

Second fire barrier 130 is typically wool or organic wool fabric. The weight of such fabric is usually greater than 15 oz/yd$^2$, 16 oz/yd$^2$, 17 oz/yd$^2$, or 18 oz/yd$^2$. In certain cases, the weight is greater than 19 oz/yd$^2$, 20 oz/yd$^2$ or 21 oz/yd$^2$.

Three-dimensional spacer 140 typically consists of one or more layers of woven fabric (air spacer). It ranges in thickness from 0.10 inch to 6 inches, and in certain cases three-dimensional spacer 140 can be used to replace core 150 (i.e., three-dimensional spacer 140 fills the entire space shown for 140 and 150 in FIG. 1).

One type of suitable woven fabric for three-dimensional spacer 140 is new or recycled polyester fibers, which, in thinner form, are sometimes used in the construction of shoes or backpacks. In certain cases the fabric is made of two covering layers that are held apart from each other at a specific distance by a pile layer. The pile layer has countless pile threads that contribute to the elasticity of the fabric.

Core 150 is typically the main structural body of the mattress—although as noted above where three-dimensional spacer 140 is thick, it can replace core 150—and it is made of natural or man-made materials. Nonlimiting examples of such materials include synthetic latex, natural latex derived from rubber trees or extracted from dandelion plants, non-toxic polyurethane, plant-based foam, and man-made materials and blends thereof. Natural latex is obtained from *Hevea Brasiliensis*; latex extracted from dandelion plants is obtained from the plant TKS (i.e., Taraxacum kok-saghyz), which is generally known as the Russian Dandelion. Dandelion-based latex can be purchased, for example, from Delta Plant Technologies, Kent, Wash. The firmness of core 150 typically ranges from an ILD of 23 to 50. In certain cases, the ILD of core 150 ranges from an ILD of 32 to 36.

Core 150 can be made and designed from non-toxic materials in a stacked formation of straws with holes providing an optimal breathable core. The other benefit of this core is manufacturing and disposal efficiencies. Both manufacturing and disposal can be done in a closed-loop system requiring minimal energy and virgin feedstock materials. The measurement of materials and energy required is done by using the SVENSRUD LOOP RATIO (SLR) which is the ratio between virgin and non-virgin (i.e., recycled materials). The SLR is often 1 for virgin materials and is 1.5, 5, or 10 for materials produced in system using recycled materials and sustainable production practices.

Structurally-fortified bottom 160 is made of natural fiber, typically hemp or organic cotton. It provides structure such that cover 110 can firmly stretch around the sides and top of sleep system 100.

The various elements of sleep system 100 are independent and are manufactured so they can be disassembled and assembled to be cleaned or replaced by a consumer. This furthermore allows for materials to be manufactured at various locations to be assembled at a final warehouse location or by the consumer.

Sleep system 100 can be sold as a higher order system along with linens, one or more pillows and a sleep sack. The linens, one or more pillows, sleep sack and sleep system 100 are designed to use the TENCEL® fabric, and the performance of the higher order sleep system is maximized by using the various stated elements.

One objective of sleep system 100 is to increase air flow, improve ventilation, and correspondingly decrease $CO_2$ concentration in the air, at the surface of the system. Two aspects that particularly contribute to these phenomena are the textured relief ridge areas on cover 110 and three-dimensional spacer 140. The relief ridge areas serve to form empty channels through which air can flow; three-dimensional spacer 140 is porous and allows relatively free movement of air from the underside of cover 110. The result is a system that significantly improves a sleeper's ability to access fresh air. This creates a healthy sleeping environment, especially for infants.

Another objective of the sleep system is to provide for washability. The appearance of the sleep system and/or its components is typically superior to that of other sleep systems and/or components according to AATTC 143-2006 (American Association of Textile Chemists and Colorists standard test, Appearance of Textile End Products after Repeated Home Laundering). The appearance according to AATTC 143-2006 is typically 2.5% better than other systems/components. In certain cases, it is 5.0%, 7.5%, 10.0%, 12.5% or 15% better. The colorfastness of the sleep system and/or its components is typically superior to that of other sleep systems and/or components according to AATTC 61-2009 (Colorfastness to Laundering). The colorfastness according to AATTC 61-2009 is typically 2.5% better than other systems/components. In certain cases, it is 5.0%, 7.5%, 10.0%, 12.5% or 15% better.

The dimensional changes of the sleep system and/or its components after laundering is typically superior to that of other sleep systems and/or components according to AATTC 135-2004 (Dimensional Changes of Fabrics after Home Laundering). The dimensional changes according to AATTC 135-2004 are typically 2.5% less than for other systems/components. In certain cases, it is 5.0%, 7.5%, 10.0%, 12.5% or 15% less.

The smoothness appearance of the sleep system and/or its components after laundering is typically superior to that of other sleep systems and/or components according to AATTC 124-2009 (Smoothness Appearance of Fabrics after Repeated Home Laundering). The smoothness appearance according to AATTC 124-2009 is typically 2.5% better than for other systems/components. In certain cases, it is 5.0%, 7.5%, 10.0%, 12.5% or 15% better.

Another objective of the sleep system is to provide a sleeping surface free from biological toxins. Infants exposed to biological toxins have been shown develop a broad range of late onset medical disorders effecting breathing, neurological system, lymphatic system, and organs. Most commonly it is linked to asthma. The sleep system present in this invention typically embeds or attaches microscopic silver and/or zinc particles to fibers that make up the cover 110. The amount of biological toxins present in a sleep system is measured by the LEVI BIO-SCALE (LBS). The LBS is determined by obtaining a toxin profile (e.g., amount and relative concentrations of particular toxins) of a sleep system that does not include embedded silver and/or zinc using any suitable method (e.g., mass spectrometry) and comparing to a toxin profile of a sleep system that does include embedded zinc. When compared to sleep systems that do not protect, or provide adequate protection, the use of the sleep system according to the present invention increases the LBS by at least 2.5 percent, 3.0 percent, 3.5 percent, 4.0 percent, 4.5 percent, or 5.0 percent.

In addition the sleep system and/or its components are typically less susceptible to mildew and rot than other sleep systems and/or components according to AATTC 30-2004 (Anti-Fungal Activity, Assessment of the Textile Materials: Mildew and Rot Resistance of Textile Materials). The susceptibility to mildew and rot according to AATTC 30-2004, is typically 2.5% less than for other systems/components. In certain cases, it is 5.0%, 7.5%, 10.0%, 12.5% or 15% less. The sleep system and/or its components typically exhibit less antibacterial activity than other sleep systems and/or components according to AATTC 100-2004 (Anti-Bacterial Finishes on Textile Materials). The antibacterial activity according to AATTC 100-2004 is typically 2.5% less than for other systems/components. In certain cases, it is 5.0%, 7.5%, 10.0%, 12.5% or 15% less. The sleep system and/or its components typically exhibit less susceptibility to dust mite activity than other sleep systems and/or components according to AATTC 194-2008 (Assessment of the Anti-House Dust Mite Properties of Textiles Under Long-Term Test Conditions). The susceptibility according to AATTC 194-2008 is typically 2.5% less than for other systems/components. In certain cases, it is 5.0%, 7.5%, 10.0%, 12.5% or 15% less.

Sleep system 100 aids infants in developing early motor and cognitive skills. This primarily results from the combination of tactile stimulation, derived from the characteristics of cover 110, visual stimulation, derived from the natural theme designs, and the substantially increased air flow discussed above. The increased stimulation and air flow improve cognitive skills as measured by the Cattell Infant Intelligence Scale (i.e., CIIS). When compared to a mattress or sleep system that does not have raised-area pods, use of the sleep system according to the present invention increases the CIIS score of a typical infant by at least 2.0 percent. In certain cases, the CIIS scores are increased by at least 2.5 percent, 3.0 percent, 3.5 percent, 4.0 percent, 4.5 percent, or 5.0 percent.

When compared to a mattress or sleep system that does not have raised area pods or natural theme designs, the CIIS scores are increased by at least 2.0 percent. In certain cases, the CIIS scores are increased by at least 2.5 percent, 3.0 percent, 3.5 percent, 4.0 percent, 4.5 percent, or 5.0 percent.

The increased air flow provided by sleep system 100 ensures that the concentration of $CO_2$ inhaled by an infant sleeping on the mattress is reduced (i.e., rebreathing of $CO_2$ is reduced); $CO_2$ inhalation by infants is thought to induce health problems, including Sudden Infant Death Syndrome (i.e., SIDS). The $CO_2$ concentration in the breathing space surrounding an infant (i.e., circular area 2 inches in diameter with mid-point being halfway between an infant's nose and mouth) lying on sleep system 100 is known as the JUNE BREATHABILITY INDEX (JBI). The JBI is typically decreased at least 2.0 percent as compared to that of an infant lying on a sleep system/mattress that does not include cover 110. In certain cases the $CO_2$ concentration is reduced at least 2.5 percent, 3.0 percent, 3.5 percent, 4.0 percent, 4.5 percent or 5.0 percent.

In certain cases, the components of the sleep system are used separately or in different combinations. Core 150 may be combined with a base (e.g., structurally fortified bottom 160) to form a basic stand alone, functioning mattress. Three-dimensional air spacer 140 may be combined with cover 110 to form a separate mattress pad.

Figure 3:
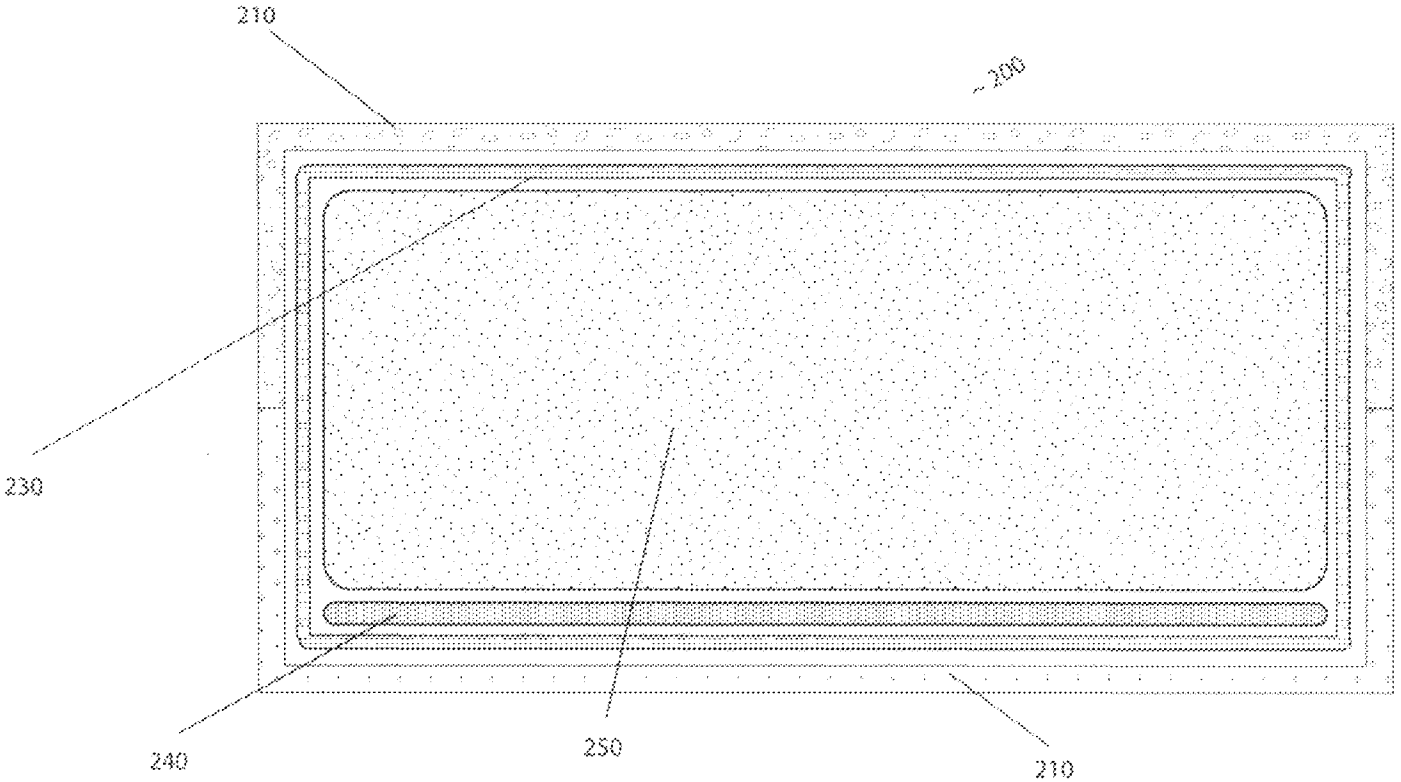
FIG. 3 shows another example of a sleep system according to the present invention.
Figure 4:
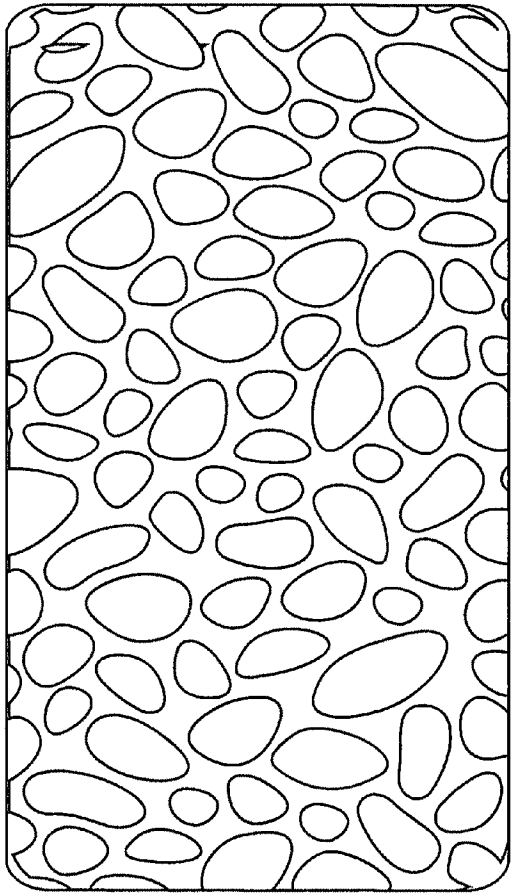
FIG. 4 shows a first design directed to a natural theme for cover 110.
Figure 5:
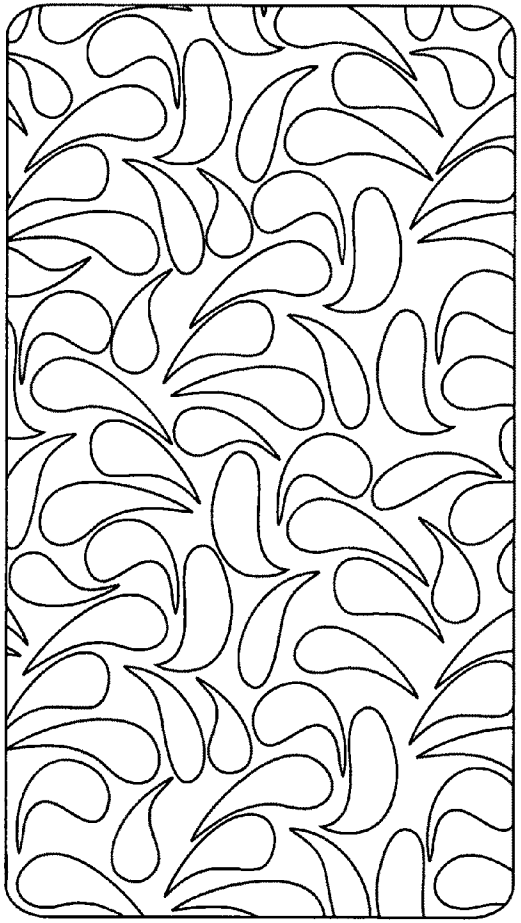
FIG. 5 shows a second design directed to a natural theme for cover 110.
Figure 6:
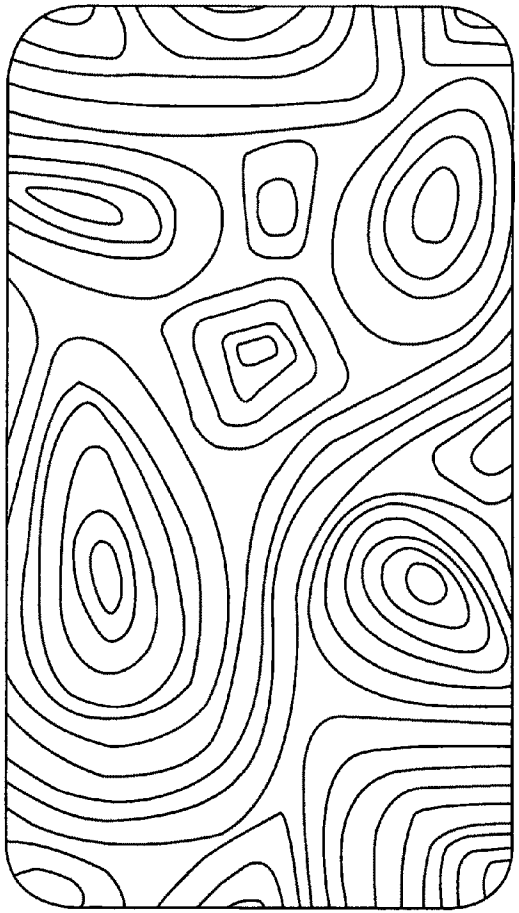
FIG. 6 shows a third design directed to a natural theme for cover 110.
Figure 7:
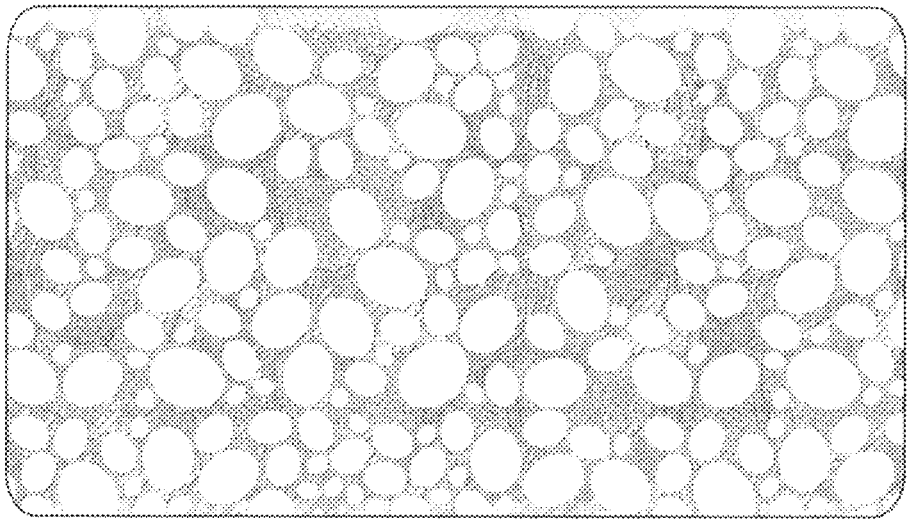
FIG. 7 shows a fourth design directed to a natural theme for cover 110.
Figure 8:
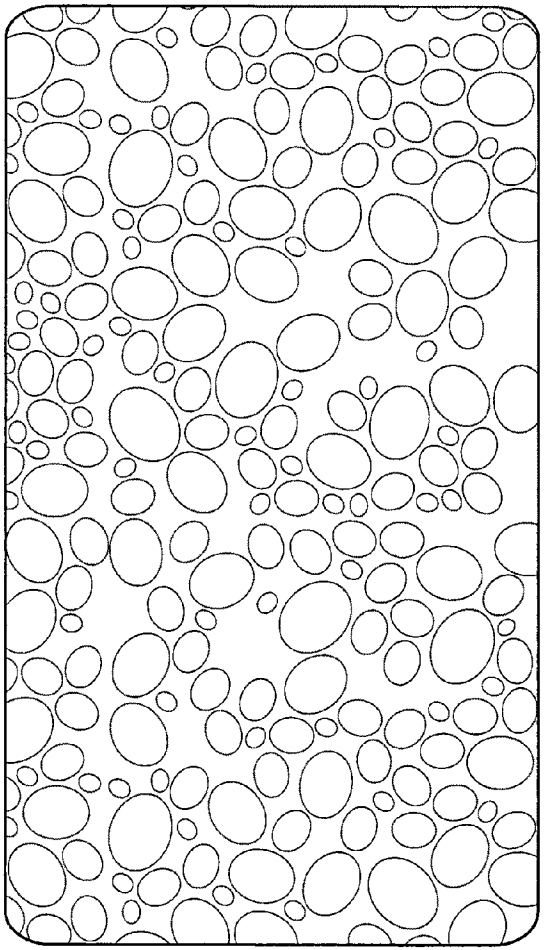
FIG. 8 shows a fifth design directed to a natural them for cover 110.

Another general sleep system (200) according to the present invention is described in reference to FIG. 3. Sleep system 200 has four basic components: a removable cover (210); a fire barrier (230); a three-dimensional spacer (240); and a core (250). As shown cover 210 is a two-piece or two-part, temperature regulating cover. The temperature regulating cover has active temperature regulating fibers or finish on one side and a fiber-based construction (as in 110, FIG. 1) on the other. Examples of active temperature regulation fibers include, without limitation, CLIMA and OUTLAST fibers (i.e., viscose fibers) or fibers that have a phase changing finish treatment.

Core 250 may be selected to provide temperature regulation capability as well. A nonlimiting example of such a core is a polyethylene foam core with TENCEL powder embedded in the foam. Sleep system 200 may also be improved by the use of sheets and bedding that also include active temperature regulating fibers or finishes.

The active temperature regulation can be measured on the HOMEOSTASIS COMPETENCY SCALE (HCS). This scale rates ability of a particular sleep system to assist in keeping the sleepers body at within a temperature range referred to as a SLEEP ZONE. This SLEEP ZONE has been determined to below body temperature during waking hours. This temperature range is referred to in infants, 0-1 year old, as the INFANT SLEEP ZONE is typically between 96.8 F and 98.6 F and in toddlers, 1-3 years old, as the TODDLER SLEEP ZONE is typically between 95.5 F and 97.2 F. When compared to sleeps systems that do not actively manage temperature, or provide adequate temperature management, the use of the sleep system according to the present invention increases the HCS by at least 2.5 percent, 3.0 percent, 3.5 percent, 4.0 percent, 4.5 percent, or 5.0 percent.

The exposed portion of systems and components according to the present invention are oftentimes resistant to water and/or oil. The aqueous liquid repellency of the system and/or components in this case is typically superior to that of other systems and/or components according to AATTC 193-2007 (Aqueous Liquid Repellency: Water/Alcohol Solution Resistance Test). The aqueous liquid repellency according to AATTC 193-2007 is typically 2.5% better than other systems/components. In certain cases, it is 5.0%, 7.5%, 10.0%, 12.5% or 15% better. The oil repellency of the system and/or components is typically superior to that of other systems and/or components according to AATTC 118-2007 (Oil Repellency: Hydrocarbon Resistance Test). The oil repellency according to AATTC 118-2007 is typically 2.5% better than other systems/components. In certain cases, it is 5.0%, 7.5%, 10.0%, 12.5% or 15% better. The water repellent efficacy of the system and/or components is typically superior to that of other systems and/or components according to AATTC 22-2005 (Water Repellency: Spray Test). The water repellent efficacy according to AATTC 22-2005 is typically 2.5% better than other systems/components. In certain cases, it is 5.0%, 7.5%, 10.0%, 12.5% or 15% better.

The exposed portion of systems and components according to the present invention oftentimes wick away moisture that comes in contact with those portions. The liquid moisture management properties of the system and/or components is typically superior to that of other systems and/or components according to AATTC 195-2009 (Liquid Moisture Management Properties of Textile Fabrics). The moisture management properties according to AATTC 195-2009 is typically 2.5% better than other systems/components. In certain cases, it is 5.0%, 7.5%, 10.0%, 12.5% or 15% better.

In certain cases, the components of the sleep system are used separately or in different combinations. Core 250 may be combined with a base to form a basic stand alone, functioning mattress. Three-dimensional air spacer 240 may be combined with cover 110 to form a separate mattress pad.

Certain components may be combined to make other types of systems. For example, the three-dimensional air spacer 130 and material used in cover 110 may be combined to make a play mat. The play mat provides a surface substantially free from bacteria; it is water, oil, and stain resistant as well. Use of the play mat according to the present invention increases the LBS by at least 2.5 percent, 3.0 percent, 3.5 percent, 4.0 percent, 4.5 percent, or 5.0 percent.

The play mat, which includes raised areas such as pods, increases the cogitative abilities infants when measured on the Cattell Infant Intelligence Scale (i.e., CIIS). When compared to a play mat that does not have raised-areas, use of the play mat according to the present invention increases the CIIS score of a typical infant by at least 2.0 percent. In certain cases, the CIIS scores are increased by at least 2.5 percent, 3.0 percent, 3.5 percent, 4.0 percent, 4.5 percent, or 5.0 percent. The play mat cover is oftentimes constructed using a highly absorbent material such as a TENCEL and cotton blend terry cloth.

In another aspect of the invention, the material used in cover 110 is made of one or more fast-drying fabrics, such as TENCEL and cotton blend terry cloth, and is directly attached to three dimensional air spacer of type 130. This combination of components provides a surface fabric raised from the floor to create and an improvement to existing bath mat designs. The raised fabric will dry more quickly and stay freer from bacteria and/or mold. When compared to existing bath mats, which do not have a three dimensional air spacer or use TENCEL fabric, the bath mat according to the present invention will dry least 2.0 percent faster. When compared to existing bath mats which do not have a three dimensional air spacer or use TENCEL fabric use of the bath mat according to the present invention has 10.0 percent less bacteria present.

The invention claimed is:

1. A sleep system, wherein the sleep system comprises:

a core;

a structurally fortified bottom; and, an asymmetric cover which surrounds said core and structurally fortified bottom wherein the cover comprises at least two raised areas, and wherein the raised areas are circular or roughly circular in shape, and wherein the raised areas have more than one height ranging from 0.25 inch to 2.0 inches; and wherein the cover is removable; and wherein the spacing between adjacent areas is equal to taking the sum of the heights of the two adjacent areas and dividing the sum by 1.618.

2. The sleep system according to claim 1, wherein at least two of the raised areas have different diameters ranging from 1.0 inch to 10.0 inches.

3. The sleep system according to claim 2, wherein the diameters of the raised areas range from 0.25 inch to 5.0 inches.

4. The sleep system according to claim 3, wherein the heights of the raised areas range from 0.125 inch to 5.0 inch.

5. The sleep system according to claim 4, wherein the raised areas have an indentation load depression rating of 10 to 50.

6. The sleep system according to claim 5, wherein the cover comprises Lyocell and recycled polyester or other performance-based and sustainable fibers.

* * * * *